US009441429B2

(12) United States Patent
Sherwood et al.

(10) Patent No.: US 9,441,429 B2
(45) Date of Patent: Sep. 13, 2016

(54) MODULAR RIG DESIGN

(75) Inventors: Joe Sherwood, Columbus, TX (US); Thomas Geehan, Houston, TX (US)

(73) Assignee: M-I L.L.C., Houston, TX (US)

( * ) Notice: Subject to any disclaimer, the term of this patent is extended or adjusted under 35 U.S.C. 154(b) by 700 days.

(21) Appl. No.: 13/823,654

(22) PCT Filed: Sep. 15, 2011

(86) PCT No.: PCT/US2011/051700

§ 371 (c)(1),
(2), (4) Date: Jun. 19, 2013

(87) PCT Pub. No.: WO2012/037313

PCT Pub. Date: Mar. 22, 2012

(65) Prior Publication Data

US 2014/0144708 A1 May 29, 2014

Related U.S. Application Data

(60) Provisional application No. 61/383,212, filed on Sep. 15, 2010.

(51) Int. Cl.

| | |
|---|---|
| ***E21B 21/01*** | (2006.01) |
| ***E21B 21/00*** | (2006.01) |
| ***E21B 15/00*** | (2006.01) |
| ***E21B 15/02*** | (2006.01) |
| ***E21B 21/06*** | (2006.01) |

(52) U.S. Cl.
CPC ..... *E21B 21/01* (2013.01); *E21B 15/00* (2013.01); *E21B 15/02* (2013.01); *E21B 21/001* (2013.01); *E21B 21/065* (2013.01)

(58) Field of Classification Search
CPC ..... E21B 15/00; E21B 15/02; E21B 21/01; E21B 21/065; E21B 21/001
USPC ..... 166/357, 358; 175/206, 207
See application file for complete search history.

(56) References Cited

U.S. PATENT DOCUMENTS

| | | | | |
|---|---|---|---|---|
| 3,688,781 | A * | 9/1972 | Talley, Jr. | E21B 21/066 134/110 |
| 3,863,811 | A | 2/1975 | Fisher et al. | |
| 4,426,817 | A | 1/1984 | Bomhard | |
| 6,170,580 | B1 * | 1/2001 | Reddoch | B01D 29/23 175/206 |
| 7,141,099 | B2 * | 11/2006 | Ross | B01D 19/0042 175/206 |
| 7,753,126 | B2 * | 7/2010 | Reddoch, Sr. | E21B 21/066 166/357 |
| 8,074,738 | B2 * | 12/2011 | McDonald | E21B 21/066 166/357 |
| 8,276,686 | B2 * | 10/2012 | James | E21B 21/066 175/206 |
| 8,316,963 | B2 * | 11/2012 | Eia | B63B 35/44 166/357 |
| 2007/0151907 | A1 | 7/2007 | Duhe et al. | |
| 2008/0283301 | A1 * | 11/2008 | Sherwood | E21B 21/01 175/206 |

OTHER PUBLICATIONS

International Search Report for PCT Application Serial No. PCT/US2011/051700 dated Jun. 19, 2012.

* cited by examiner

*Primary Examiner* — Matthew R Buck
(74) *Attorney, Agent, or Firm* — David J. Smith

(57) ABSTRACT

In one aspect, embodiments disclosed herein relate to modular drilling system, the system comprising a first module comprising a first work surface; and a second module comprising a second work surface; wherein the first module is disposed above the second module. In another aspect, embodiments disclosed herein relate to a modular drilling system, the system comprising a first module; and a second module; wherein at least one of the first and second modules comprises oilfield process equipment disposed on the module around a center point.

19 Claims, 9 Drawing Sheets

MODULAR RIG DESIGN

CROSS-REFERENCE TO RELATED APPLICATIONS

This application is a national stage application of PCT/US2011/051700, filed on Sep. 15, 2011, entitled "MODULAR RIG DESIGN," which claims priority to U.S. Provisional Patent Application No. 61/383,212, filed on Sep. 15, 2010. Each of these priority applications are incorporated herein by reference in their entireties.

BACKGROUND

1. Field of the Invention

Embodiments disclosed herein relate to apparatuses and methods for a modular drilling system. More specifically, embodiments disclosed herein relate to apparatuses and methods for providing modules for an offshore drilling rig.

2. Background Art

Oil rigs, particularly off-shore rigs, need to utilize all available space efficiently due to the number of processes that are performed and the limited amount of space provided. Most off-shore oil rigs include numerous levels or platforms and utilize gravity to move fluids between the levels, minimizing the number of pumps on the oil rig.

Various fluids ("well fluids") may be used on the oil rig and may include both solids and liquids. Common uses for well fluids include: lubrication and cooling of drill bit cutting surfaces while drilling generally or drilling-in (i.e., drilling in a targeted petroleum bearing formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, implacing a packer fluid, abandoning the well or preparing the well for abandonment, and otherwise treating the well or the formation.

Since space is a priority on an oil rig, the storage of fluids must be done efficiently. These fluids include various components that may be recycled and re-used or may be treated prior to disposal. Between the various operations, these fluids may be temporarily stored in a tank system. For example, when a wellbore fluid brings cuttings to the surface, the mixture is typically subjected to various mechanical treatments (shakers, centrifuges, etc) to separate the cuttings from the recyclable wellbore fluid. However, the cuttings may need to be treated or the recyclable wellbore fluid may need to be stored until it is used again.

In conventional rig design, the layout of oilfield processing equipment is linear in alignment and fluid is moved by building a series of ditch and tank systems in a downhill configuration using altered overflows, weirs, and angles. Fluids and solids settle out as the fluid moves slowly along the flow paths of the system. Such rig designs take up valuable main deck space and may be inefficient in separating out solids from fluids.

Accordingly, there exists a continuing need for modular drilling rig designs that provide more efficient use of rig space.

SUMMARY OF THE DISCLOSURE

In one aspect, embodiments disclosed herein relate to modular drilling system, the system comprising a first module comprising a first work surface; and a second module comprising a second work surface; wherein the first module is disposed above the second module.

In another aspect, embodiments disclosed herein relate to a modular drilling system, the system comprising a first module; and a second module; wherein at least one of the first and second modules comprises oilfield process equipment disposed on the module around a center point.

Other aspects and advantages of the invention will be apparent from the following description and the appended claims.

DETAILED DESCRIPTION

In one aspect, embodiments disclosed herein relate generally to apparatuses and methods for a modular drilling system. More specifically, embodiments disclosed herein relate to apparatuses and methods for providing modules for an offshore drilling rig.

Embodiments of the present disclosure may provide a multi-tiered rig design that allows return drilling waste to be separated in individual modules stacked vertically with respect to one another. The vertical stacking of the individual modules may thereby allow fluids to be transferred between the various modules using gravity to let the fluids fall from one level to another. Additionally, embodiments of the present disclosure may provide a "round" system that stacks the individual modules, thereby decreasing needed main deck space.

Figure 1:
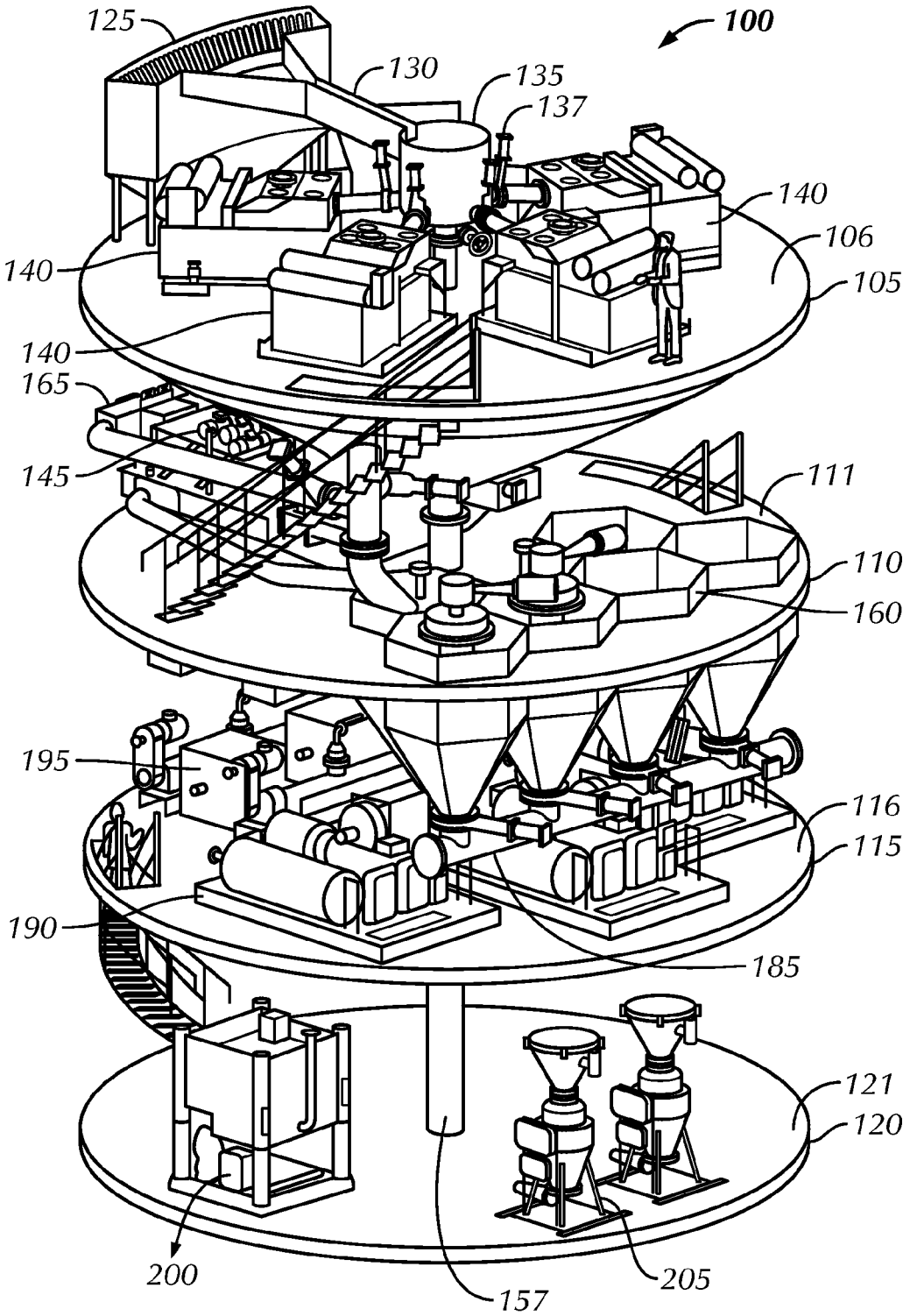
FIG. 1 is a schematic illustration of a modular rig design according to embodiments of the present disclosure.

Referring to FIG. 1, a schematic illustration of a modular rig design according to embodiments of the present disclosure is shown. As illustrated, module rig design 100 includes four modules 105, 110, 115, and 120 oriented vertically with respect to one another. In this embodiment, each of the modules 105, 110, 115, and 120 include various oilfield equipment used in the processing, treating, and storage of drilling waste. Each of modules 105, 110, 115, and 120 have a corresponding work surface 106, 111, 116, and 121 on which various types of oilfield processing equipment may be disposed. Those of ordinary skill in the art will appreciate that the specific type of oilfield equipment may vary depending on the type of operation that rig 100 is being used for.

For example, in certain embodiments, rig 100 may be used in a drilling operation, while in other embodiments, rig 100 may be used in completion, production, storage, reinjection, or other types of operations associated with the extraction and recovery of hydrocarbons.

Rig 100 includes modules 105, 110, 115, and 120, thereby allowing the modules to be interchanged as the requirements of the oilfield operation changes. Because rig 100 may serve various purposes through its life, the interchangeability of modules 105, 110, 115, and 120 may thereby improve the field life of rig 100, as well as allow the rig 100 to be modified, as required, more efficiently.

Modules 105, 110, 115, and 120 allow for a more efficient use of rig space, which is at a premium on offshore rigs. The round design of the modules 105, 110, 115, and 120 may allow for a more efficient distribution of oilfield equipment, thereby providing more free space on a rig for additional equipment that may otherwise have to be provided by boats or additional rigs.

Each module 105, 110, 115, and 120 may be independently removed from rig 100, thereby allowing rig 100 to be adapted to meet the needs of a particular operation. Those of ordinary skill in the art will appreciate that rig 100 may include more or less than four modules 105, 110, 115, and 120. In certain embodiments, rig 100 may include two modules, while in other embodiments, rig 100 may include more than four modules. Additionally, in certain embodiments, certain modules may be static and not be interchangeable, while other modules are interchangeable. The rig 100 of FIG. 1 will be described in detail below, however, those of ordinary skill in the art will appreciate that the specific equipment described below may be present in certain embodiments, while in other embodiments, the specific equipment may vary.

Referring to first module 105, first module 105 includes a first work surface 106, on which various drilling waste processing equipment is disposed. Initially, waste drilling fluid is returned from a wellbore and directed to a primary screen 125. Primary screen 125, also referred to as a gumbo screen, may be used to remove gumbo, which includes soft, sticky, swelling clay formations that are frequently encountered near the surface of a subsea well. If not removed, gumbo may clog separator screens and/or otherwise adhere to surfaces of the processing equipment, fouling tools and plugging piping. Those of ordinary skill in the art will appreciate that gumbo is typically only encountered in approximately 1% of the entire well, however, removal of the gumbo may prolong the life of the equipment and is often necessary for efficient processing of the returned drilling waste.

While gumbo is separated from a primarily effluent phase of the drilling waste, the gumbo may be directed to a separation unit disposed on second module 110, and will be discussed detail below. The effluent phase may pass through primary separator 125 down a ditch 130 to a flow distribution vessel 135. The flow distribution vessel 135 may be used to divert the flow of effluent phase between various separators 140. In this embodiment, distribution vessel 135 distributes the flow between five separators 140; however, those of ordinary skill in the art will appreciate that more or less than five separators 140 may be used depending on the volume of drilling waste, the contents of the drilling waste, space available, etc. One or more knife gate valves 137 may be disposed between distribution vessel 135 and separators 140, thereby allowing the flow to be controlled, so as to allow maintenance to one or more of separators 140 to be performed.

Figure 1B:
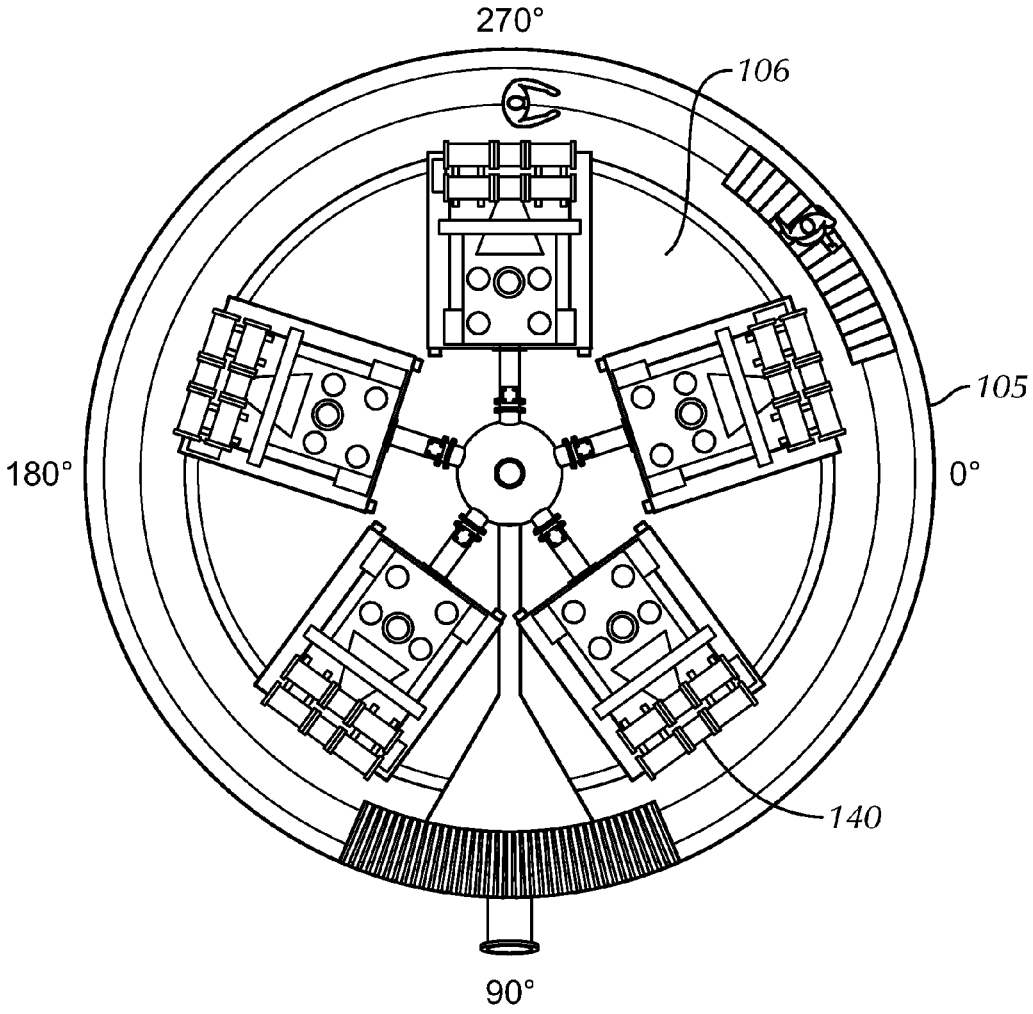
FIG. 1B is a top illustration of a modular rig design according to embodiments of the present disclosure.

In one embodiment, separators may include multiple deck separators, such as the MD-3 Shale Shaker, commercially available from M-I Swaco, L.L.C., in Houston, Tex. In certain aspects, screens for separators 140 may be used to provide for a 100 micron cut point, thereby allowing low gravity solids to be separated from the effluent phase. Based on the formation being drilled and the drilling fluid additives being used, the cut point may be adjusted to allow for the most efficient processing of the drilling waste. In this embodiment, the five separators 140 are configured to provide processing of drilling fluids in a range of 2500 to 3500 gallons per minute; however, in alternate embodiments, the configuration of separators 140 may be adjusted to allow for greater or less return rates. Referring to FIG. 1B in addition to FIG. 1, a top view of first module according to embodiments, of the present disclosure is shown. As illustrated, separators 140 are disturbed around distribution vessel 135 in approximately 72° increments; however, in alternate embodiments, separators may be distributed in different orientations depending on, for example, the number of separators 140 and/or other requirements of the drilling operation.

FIG. 1B further illustrates the disposition of separators 140 around a center point 103. In this embodiment, center point 103 is defined as distribution vessel 135. Thus, as fluid flows through primary screen 125 the fluid is gravity fed down ditch 130 and into distribution vessel 135, where the fluid is distributed to the plurality of separators 140. The orientation of the separators 140 around center point 135 allows for the more efficient use of deck space and allows separated fluid components to use gravity so that the fluids flow from one level of rig 100 to another level of rig 100. Instead of using a series of ditch and tank systems built with a downhill orientation, as described above with respect to conventional systems, the present disclosure may thereby remove the necessity for altered overflows, weirs, and angles, replacing such needs by transferring fluids from one level of rig 100 to a lower level of rig 100. Orientation of oilfield process equipment around center point 103 is not limited to the disposition of separators 140. In alternate embodiments, other equipment, such as cuttings transfer equipment, pressure vessels, storage pits, pumps, centrifuges, desanders, desilters, water/oil separation equipment, thermal dryers, etc. may be disposed around center point 103. In this embodiment, disposition of separators 140 around center point 103 may thereby allow fluids/solids to more efficiently be transferred throughout rig 100. Additionally, the center point 103 of equipment on modules 110, 115, and 120 may be said to be disposed around an overboard discharge 157. The centralized location of overboard discharge 157 may thereby allow fluids/solids to be discharged to flow to a single location. Because components may be disposed around overboard discharge 157, the removal of waste from rig 100 may be further facilitated. The orientation of oilfield process equipment around center point 103 may thereby decrease the need for main deck space while streamlining the processing and removal of drilling waste from rig 100. In this embodiment, center point 103 is generally the geometric center point of rig 100, however, in alternate embodiments, center point 103 can be a location that is not a geometric center of rig 100. For example, in an alternative embodiment, center point 103 may refer to a location about which various equipment is disposed. In alternative embodiments, center point 103 may be a location offset to the geometric center of rig 100 and/or one of the modules 105, 110, 115, and 120 such that separators 140 or other process equipment is disposed around the center point 103, but not necessarily disposed around the geometric center of rig 100.

In certain embodiments, modules 105, 110, 115, and 120 may be designed to be substantially round. Substantially round modules 105, 110, 115, and 120 may be defined as having a generally round geometry, whereby modules 105, 110, 115, and 120 are constructed from a plurality of straight line segments that appear substantially round when assembled. Thus, a plurality of round sections may be welded or otherwise coupled to form a substantially round work surface.

Figure 2:
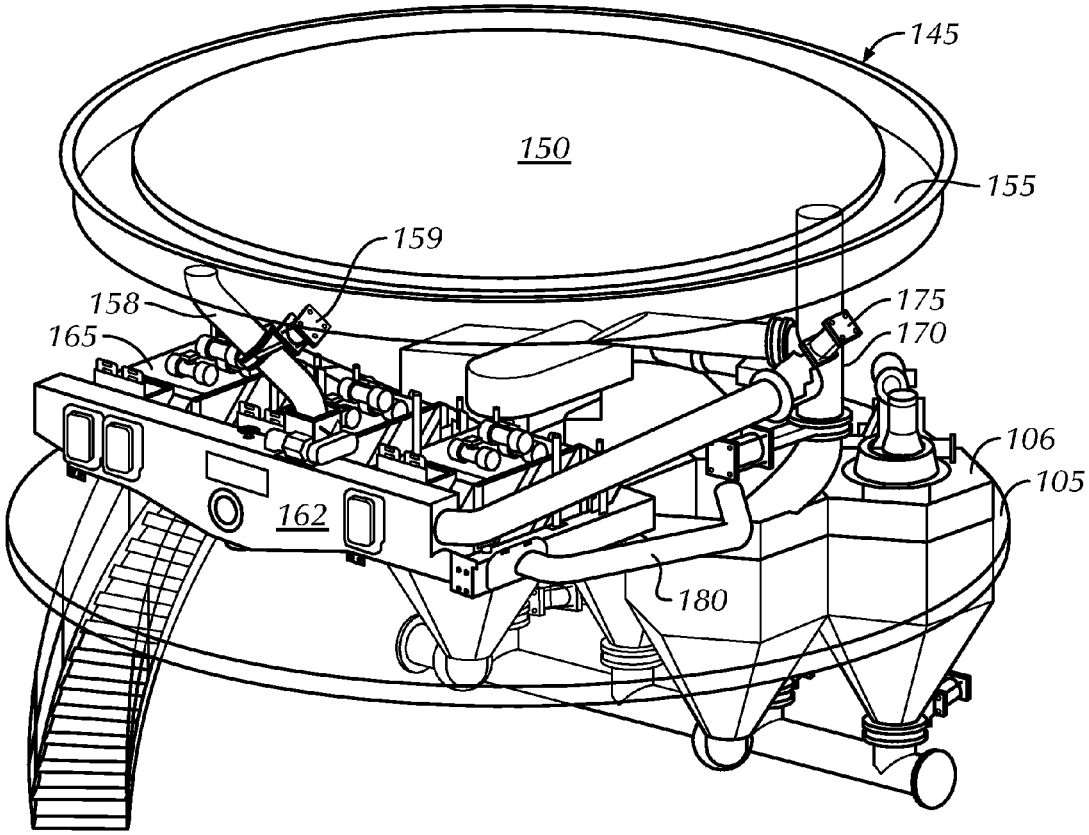
FIG. 2 shows a perspective view of a modular rig design according to embodiments of the present disclosure.
Figure 3:
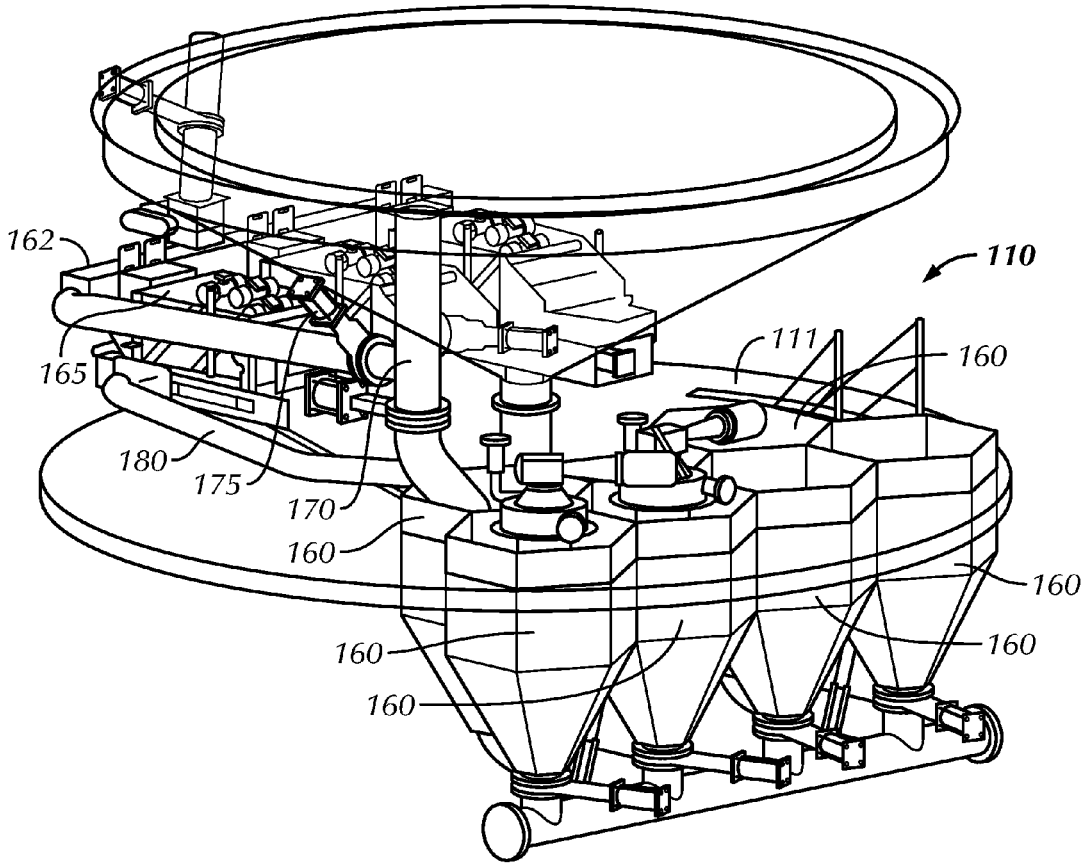
FIG. 3 shows a perspective view of a modular rig design according to embodiments of the present disclosure.
Figure 4:
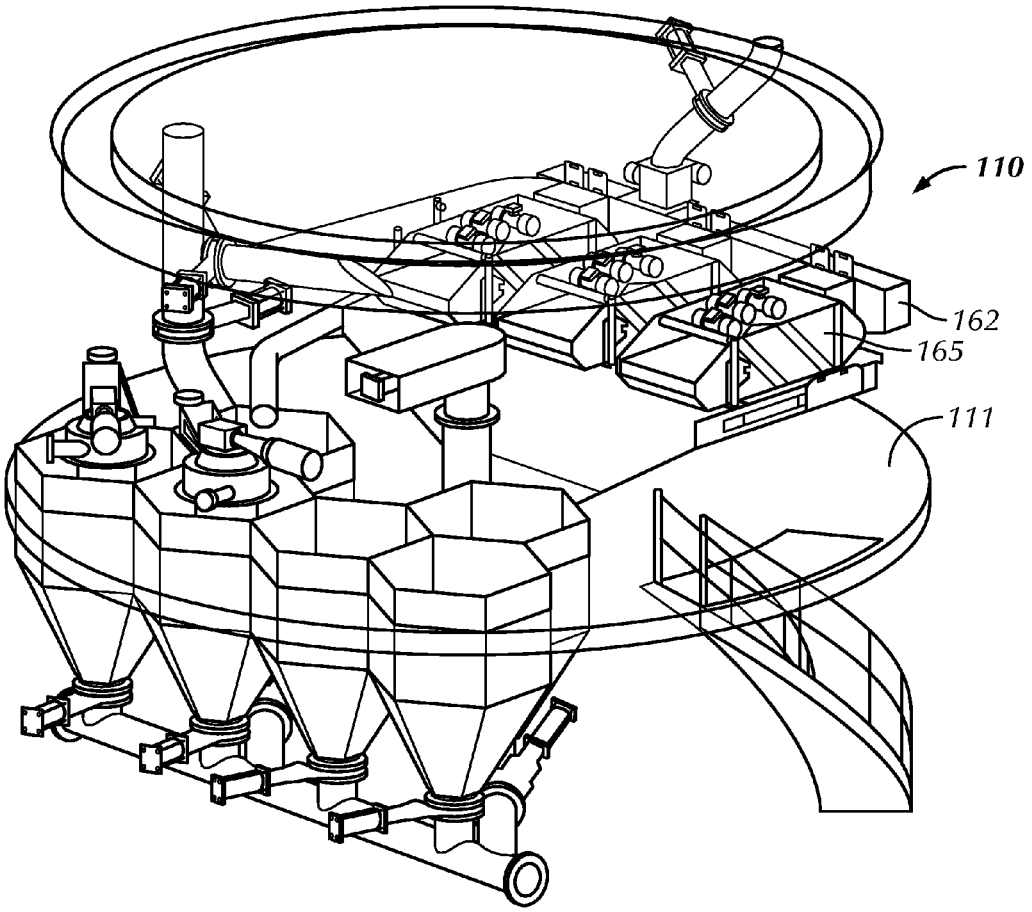
FIG. 4 shows a perspective view of a modular rig design according to embodiments of the present disclosure.
Figure 5:
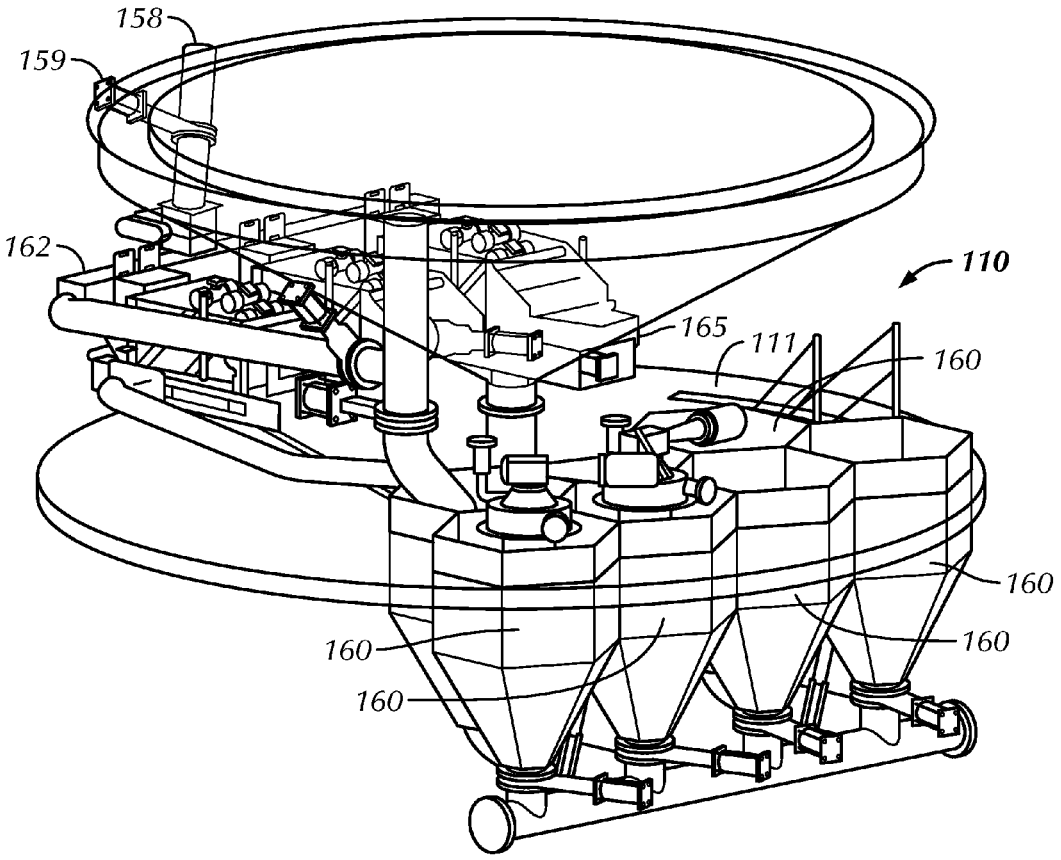
FIG. 5 shows a perspective view of a modular rig design according to embodiments of the present disclosure.
Figure 6:
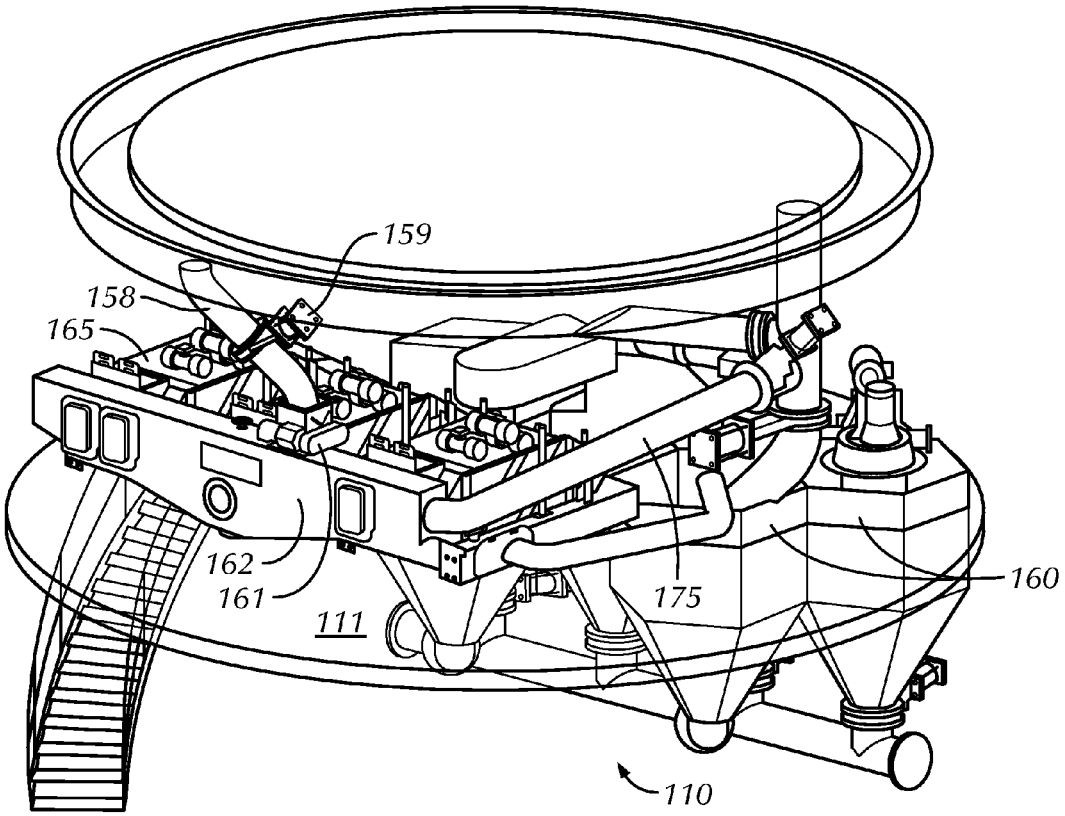
FIG. 6 shows a perspective view of a modular rig design according to embodiments of the present disclosure.
Figure 7:
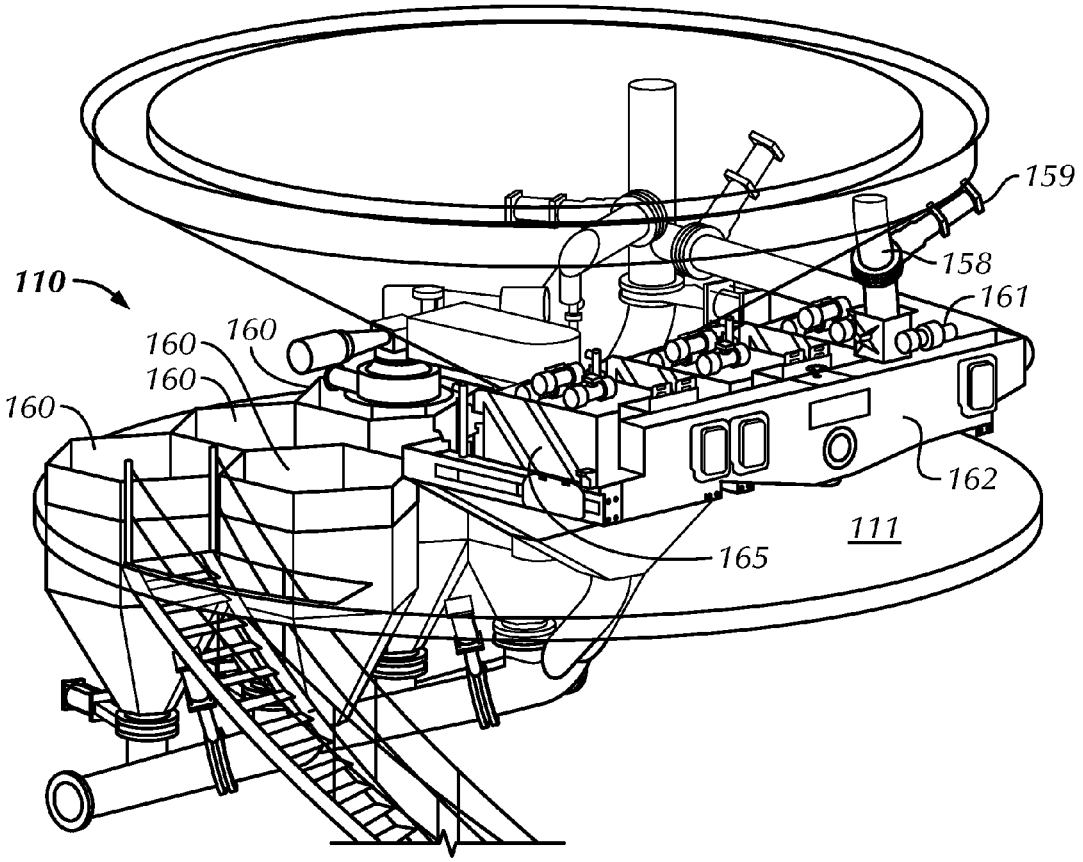
FIG. 7 shows a perspective view of a modular rig design according to embodiments of the present disclosure.

As solids are separated from the effluent phase, the solids are directed through a solids discharge (not labeled) of the separators 140 into a double walled tank 145 formed in the work surface 106. Referring to FIG. 2, in addition to FIG. 1, a close perspective view of first module 105 is shown. As illustrated, double walled tank 145 includes an inner division 150 and an outer division 155. Inner division 150 is configured to receive the effluent portion of the separator 140 discharge, while outer division 155 is configured to receive the solids portion of the separator 140 discharge. Thus, as effluent is separated from the drilling waste, the effluent is transferred from separator 140 to inner division for storage and additional processing, while the solids portion is discharged into outer portion, where the solids potion may be stored for additional processing, or otherwise discharged through overboard discharge 157.

Referring back to FIG. 1, after the drilling waste is separated into a solids phase and an effluent phase and the discrete phases are transferred to double walled tank 145, the fluid and/or effluent may be processed further on second module 110. Second module 110 includes a second work surface 111, on which various processing equipment may be disposed. In this embodiment, second module 110 includes a plurality of storage pits 160 and secondary separators 165.

Referring to FIG. 3-7, in addition to FIG. 1, various perspective views of second module 110, are shown. Effluent phase from double walled tank 145 may be transferred by conduit 170 to storage pits 160. Storage pits 160 may be interconnected, thereby allowing a flow of effluent phase to be distributed between the various pits 160. In certain embodiments, fluid may be rerouted from conduit 170 to secondary separators 165 for additional processing. In such an embodiment, a valve 175 may be opened, thereby directing effluent from doubled walled tank 145 to secondary separators 165. Examples of secondary separators 165 may include the MD-3 Shale Shaker, commercially available from M-I Swaco, L.L.C., in Houston, Tex., as discussed above, or other types of separators, such as the Gumbo Chain Separators Screening Unit, commercially available from M-I Swaco, L.L.C., in Houston, Tex. In still other embodiments, secondary separators 165 may include hydrocyclones, centrifuges, thermal drying units, or other types of separators typically used in the separation of solids from effluents in the oilfield industry.

As briefly discussed above, in certain embodiments, a primary separator 125 may initially remove gumbo or other sticky solids from the return drilling waste. In this embodiment, the gumbo may be directed from primary separator 125 through conduit 158 into secondary separators 165. Conduit 158 may include an isolation valve 159, thereby allowing a flow to secondary separators 165 to be stopped, so that, for example, maintenance may be performed on one or more of secondary separators 165. The flow from primary separator 125 to secondary separators 165 may also be controlled through use of a roto-valve 161, such as the DM500 Airlock, commercially available from Mac Equipment, Kansas City, Mo. In such an embodiment, the roto-valve 161 may be operated at 19 revolutions per minute. The roto-valve 161 may also include various features, thereby allowing the valve 161 to process gumbo material. For example, in certain embodiments, the roto-valve 161 may be modified to include a radiused pocket rotor, thereby smoothing out the portion where the blades are welded to the shaft, a Nedox coating to improve the resistance to abrasive particles in the gumbo, and air jets along the discharge to aide in removing material that might otherwise stick to the discharge. Roto-valve 161 may thus be used to facilitate the transference of gumbo from primary separator 125 to secondary separators 165.

After passing through roto-valve 161, the gumbo or other fluid entering from conduit 158 may pass though a distribution box 162, thereby separating the material between one of a plurality of secondary separators 165. Those of ordinary skill in the art will appreciate that depending on the type of secondary separation required, the type and/or number of secondary separators 165 may vary.

As drilling waste is transferred to secondary separators 165, the waste may again be separated into a solid phase and an effluent phase. The solid phase may be transferred to doubled walled tank 145 for discharge, or may otherwise be directed directly to overboard discharge 157. In still other embodiments, solids may be directed to one or more of storage pits 160 for reconstitution into drilling fluid or for storage prior to disposal. Examples of solids that may be transferred to storage pits 160 may include micronized barite and/or other weighting material used in offshore drilling.

The effluent phase separated by secondary separators 165 may be directed through conduit 180 to storage pits 160. The effluent phase may then be distributed throughout storage pits 160 for storage, treated with chemical additives prior to additional processing, or otherwise discharged from the rig.

Figure 8A:
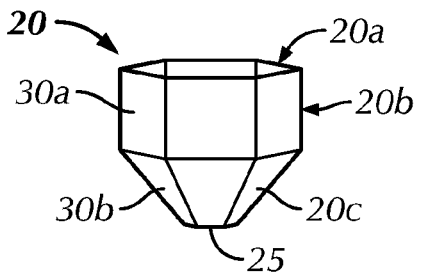
FIGS. 8A and 8B show storage pits according to embodiments of the present disclosure.
Figure 8B:
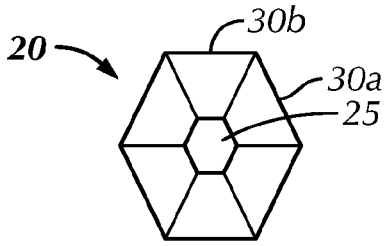

Storage pits 160 may include various designs and may be fitted with various types of equipment to further enhance the separation and storage of drilling waste. Referring to FIGS. 8A and 8B, storage pits according to one embodiment of the present disclosure is shown. As shown in FIG. 8A, a vessel 20 has an upper end 20*a*, a body section 20*b*, and a lower section 20*c*. At the lowermost end of the lower section 20*c*, the vessel is provided with an outlet 25. In a preferred embodiment, the upper end 20*a* is open to the atmosphere. In other embodiments, the upper end 20*a* may be enclosed, and the vessel 20 may be a pressurized vessel. The body section 20*b* may include at least five side walls 30*a* provided in a polygonal shape. The lower section 20*c* may include at least five bottom walls 30*b* arranged to provide the outlet 25. In a preferred embodiment, the body section 20*b* includes six side walls 30*a* providing a hexagonal shape and six bottom walls 30*b* arranged to provide the outlet 25. Baffles (not shown) may be provided in the vessel 20 to alleviate caking on the walls of the vessel 20 as well as to promote the discharge of material in the vessels. To prevent agglomeration of fluids, the vessel 20 may also include an agitator (not shown), such as a paddle shape type.

Due to the angle of the lower section 20*c* being less than a certain value, the material flow out of the vessel is of the type known as mass flow and results in all of the material exiting uniformly out of the vessel. In the case of mass flow, fluid in the vessel descends or moves in a uniform manner towards the outlet, as compared to funnel flow (a central core of material moves, with stagnant materials near the hopper walls). It is known that the critical hopper angle (to achieve mass flow) may vary depending upon the material being conveyed and/or the vessel material. In various embodiments, the angle (from the vertical axis) for mass flow to occur may be less than 40°. One of ordinary skill in the art would recognize that in various embodiments the lower section 20*c* may be conical or otherwise generally pyramidal in shape or otherwise reducing in nature, e.g., a wedge transition or chisel, to promote mass flow. In a particular embodiment, the lower angled section has a minimum discharge dimension of at least 12 inches (300 mm). The lower section 20*c* of the vessel 20 may be round and provide a round discharge 25.

Figure 9A:
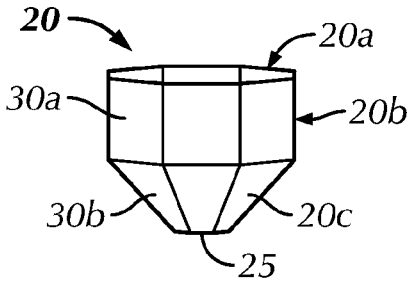
FIGS. 9A and 9B show storage pits according to embodiments of the present disclosure.
Figure 9B:
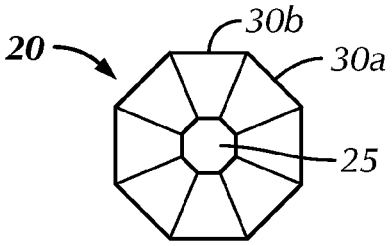

Referring to FIGS. 9A and 9B, in an alternate embodiment, the body section 20*b* may include eight side walls 30*a* providing an octagonal shape and eight bottom walls 30*a* arranged to provide the outlet 25. One skilled in the art will appreciate that any number of side walls 30*a* may be provided in a polygonal shape with a corresponding number of bottom walls 30*b*, or round bottom, arranged to provide an outlet 25. In alternate embodiments, the vessel 20 may have a polygonal shaped exterior and a round interior.

Figure 10A:
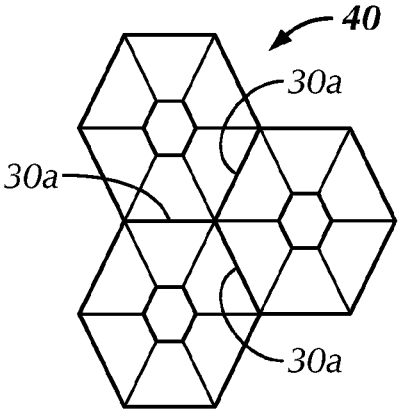
FIGS. 10A and 10B show storage pit systems according to embodiments of the present disclosure.
Figure 10B:
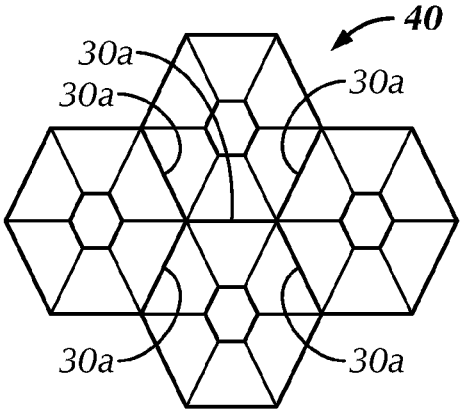

Referring to FIGS. 10A and 10B, a plurality of vessels 20 may be provided as a tank system 40. The plurality of vessels 20 are preferably manufactured to provide adjacent vessels 20 having at least one common side wall 30*a*. FIG. 3A illustrates a three tank system and FIG. 3B illustrates a four tank system. One skilled in the art will appreciate that any number of vessels 20 may be provided in a polygonal shape wherein adjacent vessels 20 have at least one common side wall 30*a*. The tank system 40 may have the vessels 20 manufactured together to provide the common side wall 30*a* while reducing the number of side walls 30*a*.

In certain embodiments, one or more of the vessels may include a tank cleaner, such as the Automatic Tank Cleaning (ATC), commercially available through M-I Swaco, L.L.C., Houston, Tex. Tank cleaning machines may be installed to automatically clean the vessels by configuring the tank cleaning machine based on the contours of the vessel to be cleaned. Tank cleaning machines may include one or more jets and tanks, thereby allowing the jets to independently follow pre-programmed paths, allowing vessels to be cleaned with little to no human interaction. In certain embodiments, multiple tank cleaning machines may be used simultaneously. Additionally, depending on the type of material being cleaned, tank cleaning machines may use various surfactants to further facilitate cleaning of the vessels.

Referring back to FIG. 1, effluent in storage pits 160 may be transferred to equipment on third module 115 via conduit 185. Third module 115 may include various types of oilfield equipment disposed on work surface 116, such as, for example, centrifuges 190 and/or thermal dryers 195. Centrifuges 190 and thermal dryers 195 may be used to further remove solid particles from the effluent, separate and/or burn off residual hydrocarbons or other chemicals from solids or effluents, and/or provide additional fluid conditioning. In alternate embodiments, third module 115 may also include desanders and/or desilters.

In certain embodiments, fluid may be fed from storage pits 160 to centrifuges 190 through one or more centrifugal pumps. In alternate embodiments, fluid may be fed from storage puts 160 to centrifuges through induction cyclone feeders, which uses an inductor to transfer fluid, thereby removing the need for a pump. After fluids are processed by centrifuges 190 and/or thermal dryers 195, the residual solids may be discharged through overboard discharge 157 or storage for later removal from rig 100. The effluent may be returned to one or more of storage pits 160, discharged through overboard discharge 160, or otherwise stored in other storage vessels (not shown).

Referring to fourth module 120, the fourth module 120 includes a work surface 121 that makes up the main deck of the rig 100. In certain embodiments various equipment may be stored on fourth module 120 or in certain embodiments, the work surface 121 may be left clear. Types of equipment that may be stored on fourth module 120 may include, for example, oil/water separation equipment 200, such as those disclosed in U.S. patent application Ser. No. 12/170,028, assigned to the assignee of the present application, and hereby incorporated by reference herein, pressurized storage and transfer equipment, such as the Cuttings Blower 205, commercially available from M-I Swaco L.L.C., Houston Tex. and the ISO-Pump, commercially available from M-I Swaco L.L.C., Houston Tex.

Depending on the requirements of the oilfield operation, one or more of the modules may be adjusted and/or modified. For example, in an embodiment where cuttings are being reinjected, third module 115 may be removed and a cuttings reinjection module (not shown), including multiple pumps, slurry mixing tanks, etc., may be installed. Other types of modules that may be used include, for example, wellbore completion modules, hydraulic fracturing modules, production modules, and the like.

In certain embodiments, individual oilfield processes may also be containerized, thereby allowing for ease of transportation and installation of individual oilfield process equipment. For example, a vibratory separator may be containerized by disposing the process (i.e., the separators) in a standardized high cube container having particular dimensions. The container may have at least one inlet without least one outlet, thereby allowing drilling waste to be transferred into the container, be processed, and then removed from the container. In such an embodiment, the container would preferably have at least two outlets, thereby allowing the solids phase and the effluent phase to be independently removed. Other types of equipment that may be containerized include centrifuges, hydrocyclones, desanders, desilters, thermal dryers, reinjection equipment, completion equipment, hydraulic fracturing equipment, etc. By containerizing the equipment, the skids that equipment is typically transported on may be removed, thereby decreasing the weight of the equipment. The container may also have lifting eyes, thereby allowing for ease of moving the equipment onto shipping vessels, off of rigs, etc.

Advantageously, embodiments of the present disclosure may provide a modular rig system, thereby allowing rigs to be assembled and reconfigured more efficiently. Additionally, embodiments may advantageously provide a round design, thereby allowing for more efficient use of rig space, allowing for additional processes to be performed using less space that is typically required. The round design may decrease the amount of space required by half over that of typical rig orientation.

Advantageously, by orienting oilfield process equipment around a center point, main deck space needed may be decreased. Also advantageously, embodiments of the present disclosure may allow gravity to assist the flow of fluids/solids from one level of the rig to a second level of the rig, thereby providing a more efficient transfer of fluids and/or solids during the separation process.

Additionally, the modular design of the rig may allow for the substitution of various oilfield process equipment more efficiently. For example, in certain embodiments, a first module, such as a secondary separation module, may be substituted for a second module, such as a cuttings reinjection module, thereby allowing the rig to be more efficiently adapted to the needs of the operation. In still other embodiments, modules for other operations, such as completion, hydraulic fracturing, production, cuttings transfer, drilling waste transfer, and the like, may be substituted during operation of the rig.

Embodiments disclosed herein may also advantageously require less fabrication time and use fewer materials in the fabrication, thereby decreasing overall equipment cost. Such designs may also result in increased deck space for completion operations and other rig needs. Embodiments may also advantageously provide compartmentalized methods of transporting and installing equipment, thereby increasing the efficiency of equipment transportation and installation.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A modular drilling system for an offshore drilling rig comprising:

a first module comprising a first work surface and a double walled tank disposed within the first module beneath the first work surface, the double walled tank comprising an inner portion for receiving an effluent phase of drilling waste and an outer portion for receiving a solids phase of the drilling waste; and a second module disposed below the first module, the second module comprising a second work surface and at least one storage pit, the at least one storage pit in fluid communication with the inner portion of the double walled tank; and a plurality of vibratory separators oriented around and fluidly connected to an overboard discharge positioned at a center point of the second module.

2. The system of claim 1, wherein the first module comprises at least one vibratory separator.

3. The system of claim 1, wherein the at least one storage pit comprises more than four sides.

4. The system of claim 1, further comprising a third module comprising a third work surface.

5. The system of claim 4, wherein the third module comprises at least one separator device.

6. The system of claim 4, further comprising a fourth module comprising a fourth work surface.

7. The system of claim 1, wherein the first module is in fluid communication with the second module through the overboard discharge.

8. The system of claim 1, wherein at least one of the first and second modules is substantially round.

9. A method of using a modular drilling system for an offshore drilling rig comprising:

transferring drilling waste from a wellbore to a first module of the rig, the first module comprising a first work surface and a double walled tank disposed within the first module beneath the first work surface;

separating the drilling waste into a solids portion and an effluent;

disposing the effluent within an inner portion of the double walled tank;

disposing the solids portion within an outer portion of the double walled tank;

transferring the solids portion to a plurality of vibratory separators disposed in fluid connection with an overboard discharge positioned at a center point of a second module of the rig, the second module disposed below the first module; and transferring the effluent to at least one storage pit included with the second module of the rig.

10. The method of claim 9, further comprising:

discharging the solids portion from the first module through the overboard discharge, the overboard discharge extending between and in fluid communication with the first module and the second module.

11. The method of claim 9, further comprising:

separating the effluent from the inner portion of the double walled tank into a second solids portion and a second effluent on the second module.

12. The method of claim 9, further comprising:

transferring at least one of the solids portion and the effluent to a third module of the rig.

13. A module for an offshore drilling rig comprising:

a work surface;

a primary separator disposed on the work surface;

a distribution vessel disposed on the work surface and in fluid communication with the primary separator;

a plurality of separators disposed around and in fluid communication with the distribution vessel, the plurality of separators also in communication with an overboard discharge positioned at a center point of the module; and a double walled tank disposed below the work surface and in fluid communication with the plurality of separators.

14. The module of claim 13, wherein an effluent phase from the plurality of separators is configured to flow into an inner portion of the double walled tank and wherein a solids phase from the plurality of separators is configured to flow into an outer portion of the doubled walled tank.

15. The module of claim 13, wherein the primary separator is configured to separate a return flow of drilling waste into an effluent phase and a solids phase.

16. The module of claim 15, wherein the primary separator comprises an outlet configured to discharge the solids phase therefrom below the work surface using gravity.

17. The module of claim 16, further comprising:

a ditch disposed between the primary separator and the distribution vessel, that is configured to pass the effluent phase from the primary separator to the distribution vessel.

18. The module of claim 15, wherein an outer portion of the double walled tank is configured to receive the solids phase.

19. The module of claim 18, wherein the overboard discharge configured to receive the solids phase from the outer potion of the double walled tank.

* * * * *